US007044511B2

(12) United States Patent
Kliefoth et al.

(10) Patent No.: US 7,044,511 B2
(45) Date of Patent: May 16, 2006

(54) MAGNETIC LATCH SYSTEM

(75) Inventors: Christopher Kliefoth, Tampa, FL (US); E. Erik Timothy, Apollo Beach, FL (US)

(73) Assignee: Nationwide Industries, Tampa, FL (US)

( * ) Notice: Subject to any disclaimer, the term of this patent is extended or adjusted under 35 U.S.C. 154(b) by 30 days.

(21) Appl. No.: 10/971,709

(22) Filed: Oct. 25, 2004

(65) Prior Publication Data

US 2005/0225098 A1 Oct. 13, 2005

Related U.S. Application Data

(60) Provisional application No. 60/560,967, filed on Apr. 12, 2004.

(51) Int. Cl.
*E05C 17/56* (2006.01)

(52) U.S. Cl. ..... 292/251.5; 292/254

(58) Field of Classification Search ..... 292/251.5, 292/341.15, 341.16, DIG. 29, DIG. 65, 130, 292/183, 230, 163, 254; 49/280; 70/276, 70/413, 278.1
See application file for complete search history.

(56) References Cited

U.S. PATENT DOCUMENTS

| | | | | |
|---|---|---|---|---|
| 2,219,186 | A | 10/1940 | Hornfeck | |
| 2,288,688 | A | 7/1942 | Dubilier | |
| 2,586,900 | A | 2/1952 | Alderman | |
| 2,659,115 | A | 11/1953 | Anderson et al. | |
| 2,801,870 | A | 8/1957 | Davey | |
| 2,808,281 | A | 10/1957 | Poe | |
| 2,864,637 | A | 12/1958 | Teague et al. | |
| 2,877,041 | A | 3/1959 | Foley | |
| 2,942,907 | A | 6/1960 | Nagel | |
| 2,970,857 | A | 2/1961 | Squire | |
| 3,066,964 | A | 12/1962 | Lemaire | |
| 3,069,193 | A | 12/1962 | Kirk | |
| 3,273,925 | A | 9/1966 | Graham | |
| 3,350,127 | A | 10/1967 | Hekelaar | |
| 3,413,026 | A | 11/1968 | Kendrick et al. | |
| 3,516,701 | A | 6/1970 | Graham | |
| 3,600,025 | A | 8/1971 | Brainard | |
| 3,664,699 | A | 5/1972 | Weigelt | |
| 3,790,197 | A | 2/1974 | Parker | |
| 3,794,366 | A | 2/1974 | Graham | |
| 3,872,696 | A * | 3/1975 | Geringer | 70/145 |
| 4,270,781 | A | 6/1981 | Nishimura | |
| 4,641,867 | A | 2/1987 | Geringer et al. | |
| 4,702,506 | A | 10/1987 | Iimura | |

(Continued)

FOREIGN PATENT DOCUMENTS

| | | |
|---|---|---|
| JP | 3039580 | 2/1991 |

(Continued)

*Primary Examiner*—Brian E. Glessner
*Assistant Examiner*—Mark Williams
(74) *Attorney, Agent, or Firm*—George R. McGuire; Bond, Schoeneck & King, PLLC

(57) ABSTRACT

A magnetic latch system including a latch assembly and a keeper assembly. The keeper assembly includes a magnetically attractable keeper pin. The latch assembly includes a magnet and a movable internal lever which is arranged to engage the keeper pin to move it away from the permanent magnet. The system may also include a lock to hold the internal lever in a fixed position so that it cannot be moved to move the keeper pin away from the magnet.

14 Claims, 10 Drawing Sheets

U.S. PATENT DOCUMENTS

| | | | | | |
|---|---|---|---|---|---|
| 5,029,912 | A | * | 7/1991 | Gotanda | 292/143 |
| 5,114,195 | A | | 5/1992 | Martin et al. | |
| 5,362,116 | A | * | 11/1994 | Doyle et al. | 292/144 |
| 5,409,275 | A | | 4/1995 | Yoshida et al. | |
| 5,475,996 | A | * | 12/1995 | Chen | 70/279.1 |
| 5,487,289 | A | | 1/1996 | Otto, III et al. | |
| 5,664,769 | A | | 9/1997 | Sadinsky et al. | |
| 5,934,119 | A | | 8/1999 | Keller | |

FOREIGN PATENT DOCUMENTS

| | | | |
|---|---|---|---|
| JP | 3191187 | A2 | 8/1991 |
| JP | 3212589 | | 9/1991 |
| JP | 5340149 | | 12/1993 |
| JP | 7233666 | | 9/1995 |
| JP | 8210001 | A2 | 8/1996 |
| WO | WO 03/067004 | | 8/2003 |

* cited by examiner

MAGNETIC LATCH SYSTEM

RELATED APPLICATIONS

This application is based upon the magnetic latch disclosure found in U.S. Provisional Application Ser. No. 60/560,967 filed Apr. 12, 2004.

FIELD OF THE INVENTION

The present invention relates to a magnetic latch and, more particularly, to a magnetic latch system useful for latching a gate to a fence post.

BACKGROUND ART

U.S. Pat. No. 5,362,116 discloses a magnetic latch system which is self latching in a predetermined position. The system includes a latch arm mounted on one gate member (e.g., post). The latch arm is movable between a latched and a retracted position. The system also includes a retaining element incorporating a permanent magnet and adapted to be mounted on a second gate member (e.g., gate). The latch arm is spring biased into the retracted position but, when it is located over the magnet, it is caused to move by the magnetic field of the magnet into a latched position wherein the latch arm engages the retaining element. In order to unlatch the latch arm from the retaining element, a lifting mechanism extends vertically above the latch arm and permits a user to manually retract the lower end of the latch arm from the permanent magnet in the retaining element. This prior art magnetic latch system does not allow for the easy opening of the gate from the front and/or the back side of the gate. Other exemplary prior art magnetic latches are disclosed in U.S. Pat. No. 3,790,197 to Parker; and U.S. Pat. No. 5,114,195 to Martin et al.

SUMMARY OF THE INVENTION

In view of the foregoing, it should be apparent that a need still exists in the art for a locking device that avoids the problems inherent in the prior art systems. Accordingly, it is a primary object of the present invention to provide an improved magnetic lock assembly which is of a simple, reliable, robust and reversible construction and in which, during unlatching, the keeper pin is positively moved away from the permanent magnet in the latch assembly by way of an internal lever operable from either side of the gate.

The latch of the present invention may be used to replace latches that are typically spring or gravity activated. Spring and gravity activated locks have some resistance to latching and require a force to be applied to the gate to get it "past" the latching mechanism to fully latch. It is then gravity or the spring that keep the mechanism latched. With the present invention, there is no substantial force required to latch. In fact, it is quite the opposite in that the magnet actually pulls the gate closed once the gate is nearly closed. This "positive latching" operation is a substantial advantage over the spring and gravity locks.

Another object of the invention is to provide a magnetic latch system adapted to secure a movable gate element relative to a fixed post element. The magnetic latch system includes a latch assembly adapted for mounting on the gate element and a keeper assembly adapted for mounting on a relatively fixed post element. The keeper assembly includes a keeper base, a magnetically attractable keeper pin movably mounted on the keeper base and a coil spring for biasing the keeper pin in a normally upward position. The latch assembly comprises a base mountable on the movable gate element, a spindle rotatably mounted on the base and a handle mounted on the spindle for manual rotation of the spindle. Also mounted on the spindle is an internal lever mounted for rotation with the rotation of the spindle. The internal lever has an outward end spaced from the spindle and it is movable in an upward and downward direction by rotation of the handle. The base also mounts a permanent magnet. The magnetic latch system according to the present invention involves a latch assembly which is adapted to be cooperatively arranged with the keeper assembly so that the permanent magnet in the latch assembly acts to attract the keeper pin in a downward direction when the keeper pin is adjacent said magnet. The internal lever mounted on the spindle is arranged to engage the keeper pin and move it in an upward direction to reduce the magnetic attraction between the keeper pin and the permanent magnet. The base for the latch assembly and the gate element are adapted to be movable into a position where the keeper pin engages the base when the keeper pin is in its downward position under the force of magnetic attraction between the keeper pin and the permanent magnet and the keeper pin disengages from the base when the keeper pin is moved upwardly by the internal lever during rotation of the handle and the attached spindle.

According to another aspect of the present invention, the keeper base has a back plate for mounting on the fixed post element and a keeper housing mounted on the back plate.

According to another aspect of the present invention, the keeper housing is slidably mounted on the back plate so that the housing is adjustable or can be reoriented 180° relative to the back plate.

According to still a further aspect of the present invention, the keeper housing is slidable in a substantially vertical direction on the back plate.

A further aspect of the present invention involves a keeper housing connected to the back plate by a mortise and tenon or dove-tail attachment.

According to still another aspect of the present invention, the keeper housing encloses the keeper pin and the coil spring.

According to still another aspect of the present invention, the spindle on the latch assembly extends from the front to the back of the gate element and each end of the spindle has a handle for manual rotation of the spindle.

According to another aspect of the present invention, the latch assembly includes an internal lever which is mounted on the spindle by a lost-motion connection which includes an opening through the internal lever, the opening receiving the spindle and having an internal lug engageable by a surface on the spindle. The spindle and lug are arranged to permit partial rotation of the spindle in the opening until the spindle engages the internal lug and then begins to provide a turning movement to said internal lever.

According to another aspect of the present invention, the latch assembly mounts the permanent magnet on the latch assembly base at a first vertical location and the internal lever mounted on the spindle is normally positioned with its longitudinal axis at substantially the same vertical location. Further, the keeper pin has a lower end that is positioned at substantially the same vertical location when the keeper pin is in its downward position.

According to another aspect of the present invention, the keeper pin is spaced from the keeper base and the latch assembly base has a wall portion that is interposed between the keeper pin and the keeper base when the keeper pin is in its downward position. This enables the wall portion to be held against the keeper base and is blocked from movement relative to the keeper pin.

In another aspect of the invention, a key cylinder can be mounted in the housing such that the engagement ears of the cylinder can selectively engage a locking protrusion on the internal lever allowing the lever to be locked in place or to be freed to be rotated by the handles.

With the foregoing and other objects, advantages and features of the invention that will become apparent hereinafter, the nature of the invention may be more clearly understood by reference to the following detailed description of the invention, the appended claims and to the several views illustrated in the attached drawings.

DETAILED DESCRIPTION OF THE INVENTION

Figure 1:
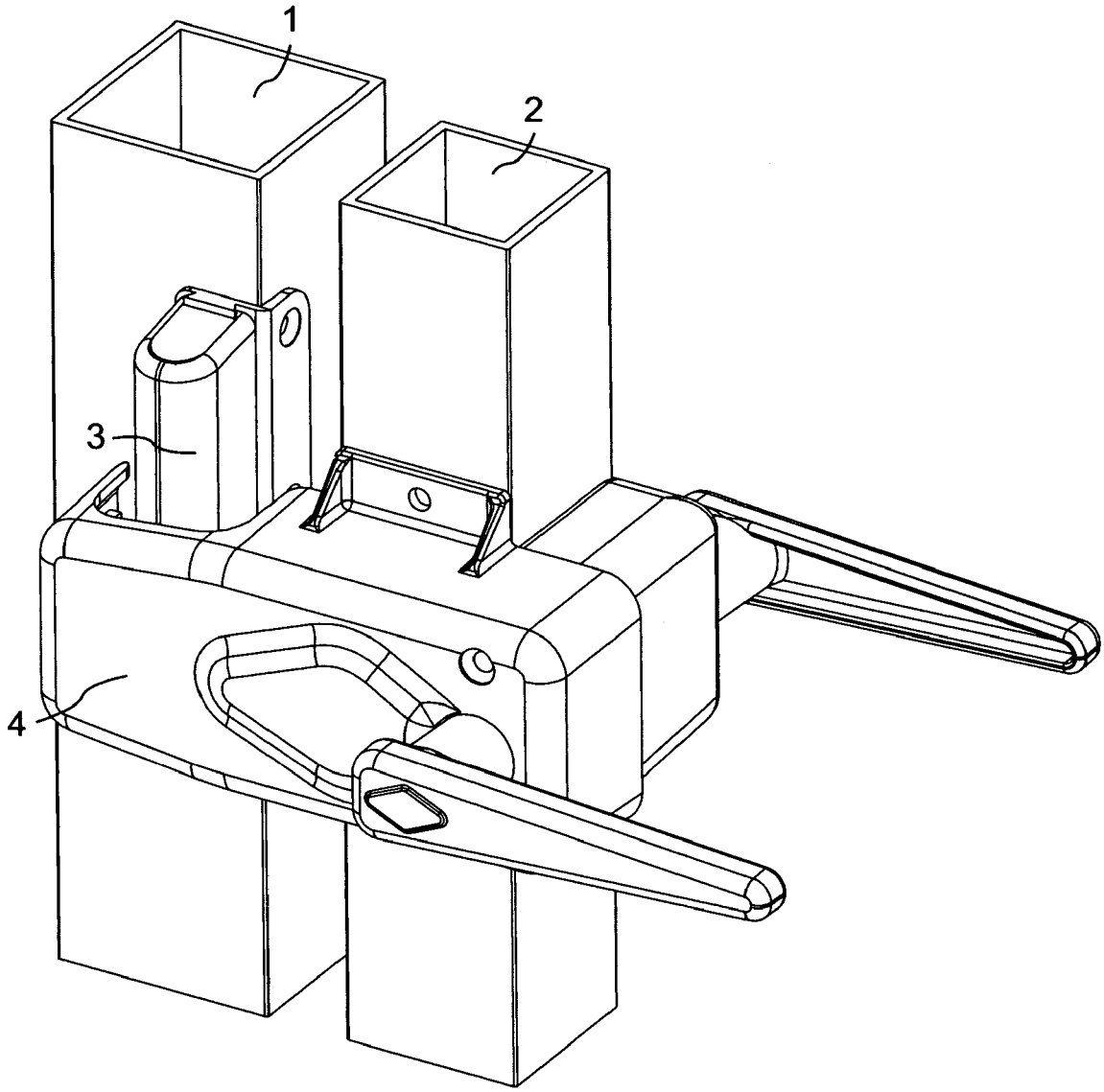
FIG. 1 is an overall perspective view of one embodiment of the magnetic latch system mounted to fence and gate posts.
Figure 2:
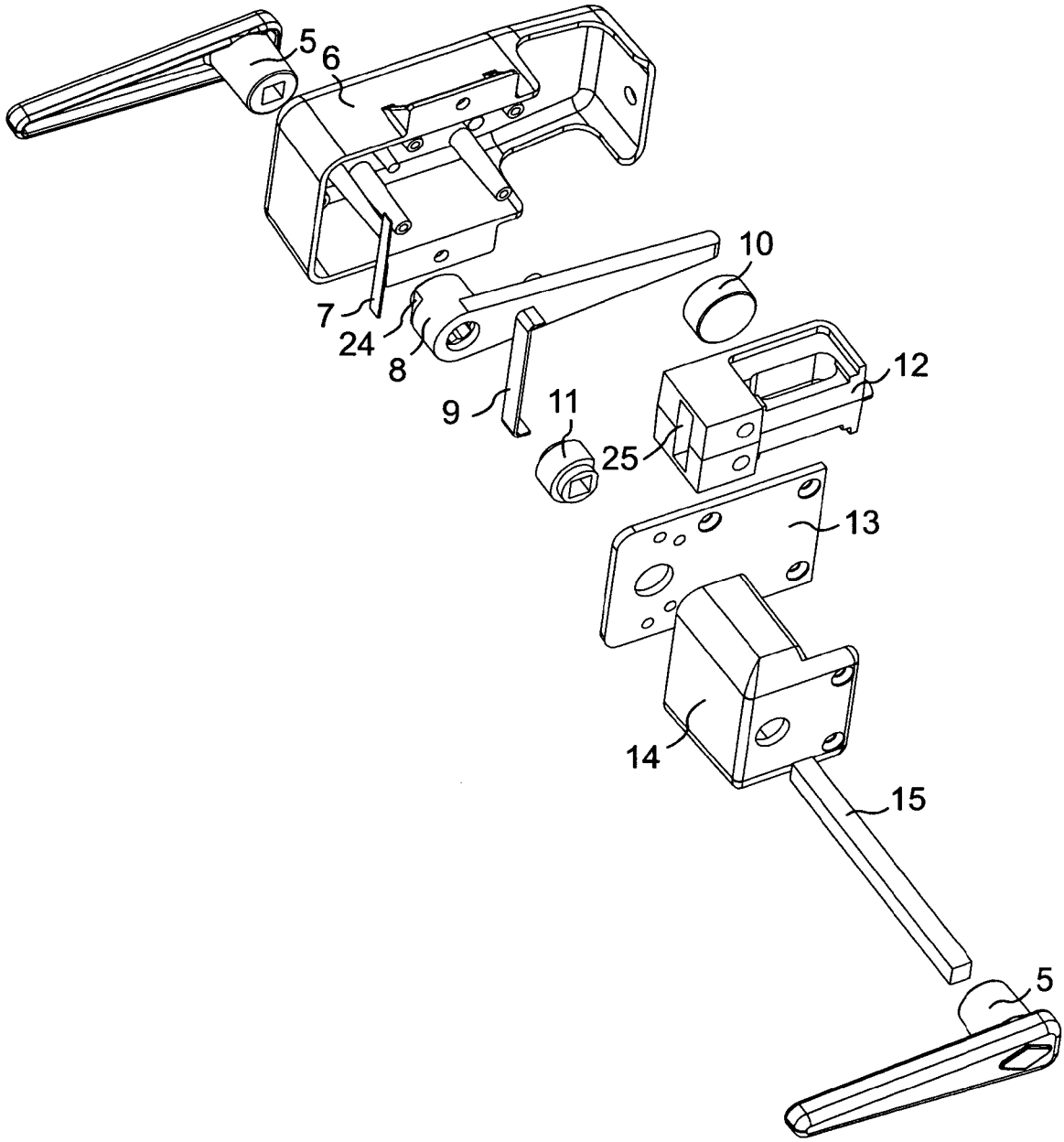
FIG. 2 is an exploded view of the latch assembly of FIG. 1.

FIG. 1 of the drawings shows the magnetic latch assembly of the present invention including the latch assembly 4 which is mounted on to the gate post 2 and the keeper assembly 3 which is mounted to the fence post 1. FIG. 1 depicts the magnetic latch assembly and gate and fence post in a closed and latched position. FIG. 2 of the drawings shows an exploded view of the latch assembly 4 more generally depicted in FIG. 1. Handles 5 are mounted to either end of the spindle 15. The spindle 15 is mounted through the front housing 6, back cover 13 for the front housing and back housing 14. The internal lever 8 and spindle spring bushing 11 are mounted on the spindle 15 inside of the housing components when the assembly is arranged. A lever spring 7 acts upon a flat surface 24 on the internal lever 8 and acts to bias the internal lever 8 into a horizontal position. A handle spring 9 acts on a flat spot 16 on the spindle spring bushing 11 to bias the handles 5 into a horizontal position. The magnet housing 12 is mounted within the front housing component. The internal lever 8 is mounted through a recess 25 in one of the magnet housing 12. A magnet 10 is mounted into a recess 28 in one side of the magnet housing 12 as best seen in FIG. 3.

Figure 3:
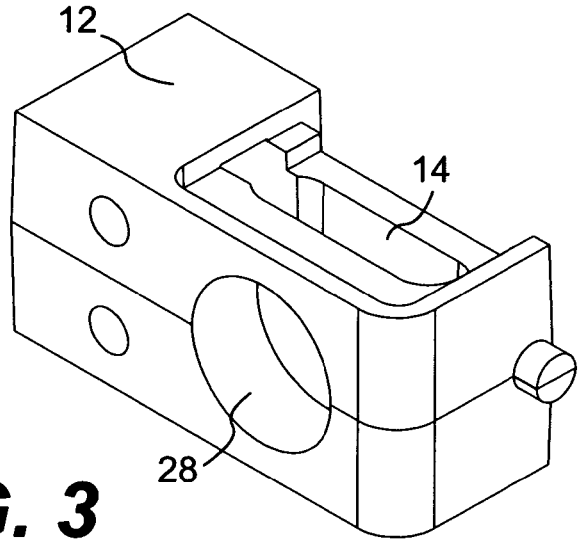
FIG. 3 is a perspective view of the magnet housing utilized in the latch assembly of FIG. 2.

FIG. 3 depicts an enlarged view of the magnet housing 12 with recess 28 for mounting the magnet 10 and wall 14 which form an opening therebetween within the magnet housing 12.

Figure 4:
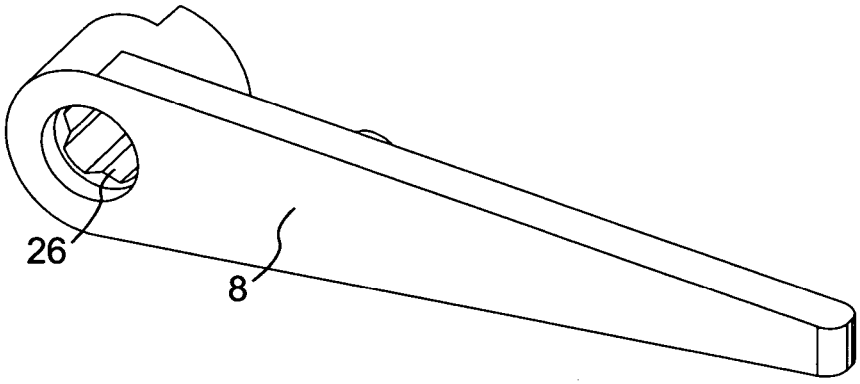
FIG. 4 is a perspective view of the internal lever used in the latch assembly of FIG. 2.

FIG. 4 shows an enlarged view of the internal lever 8. The lever 8 has a through hole 26 which contains internal lugs for mounting over the spindle 15. The spindle 15 is able to turn slightly before contacting the lugs 26 which allows the handles 5 to rotate more degrees than required to actually unlatch the mechanism. This additional rotation is to allow for a more conventional handle feel for the user of the latch.

Figure 5:
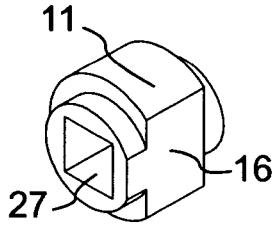
FIG. 5 is a perspective view of a spindle spring bushing shown in FIG. 2.

FIG. 5 is an enlarged view showing the spindle spring bushing 11 with aperture 27 which fits over the spindle 15 and is essentially the same size and shape as the spindle 15. This spindle spring bushing rotates fully and without free play between spindle 15 and the bushing 11 when the handles 5 are turned.

Figure 6:
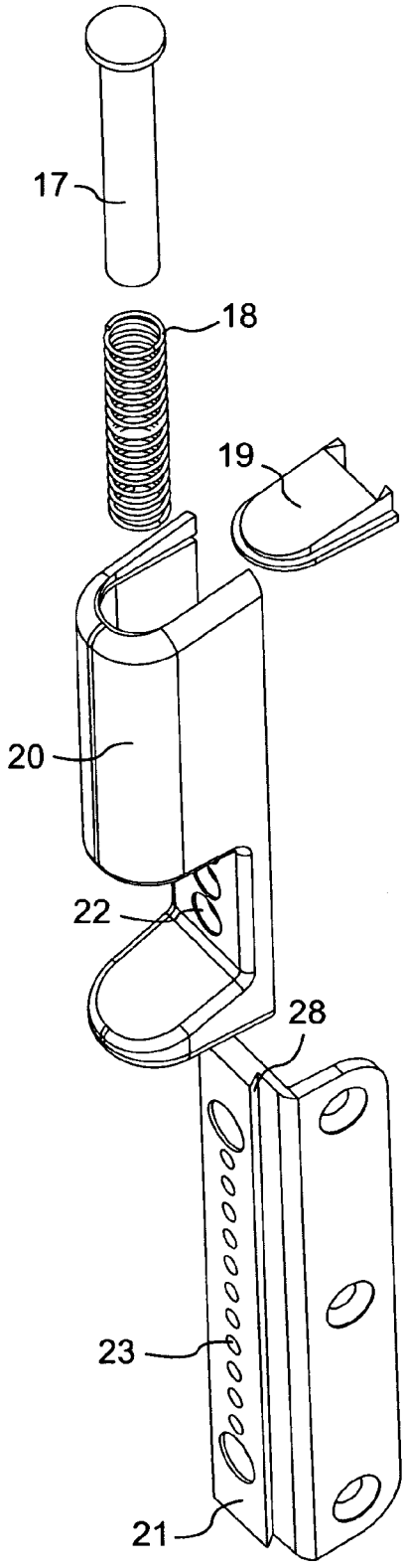
FIG. 6 is an exploded view of a keeper assembly according to one embodiment of the present invention.

FIG. 6 is an exploded view of the keeper assembly 3 depicted in FIG. 1. A pin spring 18 fits over keeper pin 17 and through a hole in the keeper housing 20. A keeper cap 19 engages the top of keeper housing 20 and retains the pin 17 and pin spring 18 within the keeper housing 20. The back of the keeper housing 20 is shaped along its vertical edges to fit over and form a "dove-tail" or mortise and tenon joint with the protrusion 28 on the front of the keeper back plate 21 to hold it in position, while allowing it to slide vertically for adjustment. The "dove-tail" joint also permits the keeper housing to be rotated 180° and mounted so that the keeper assembly can be mounted on a gate of opposite hand. A screw (not shown) is then attached through one of the holes 22 on the front of the keeper housing 20 into one of the holes 23 on the front of the keeper back plate to hold the keeper housing in the desired vertical position relative to the keeper back plate.

Figure 7:
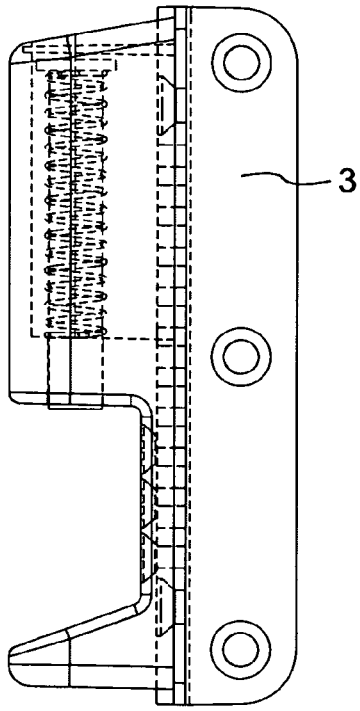
FIG. 7 is a side view of one embodiment of the keeper assembly of the present invention with the keeper pin in a raised, unlatched position.

FIG. 7 shows the keeper assembly 3 with the keeper pin in the unlatched position. In this position, the pin 17, which is made of a magnetic material, is in the fully retracted upward position with the pin spring 18 biasing it into this position.

Figure 8:
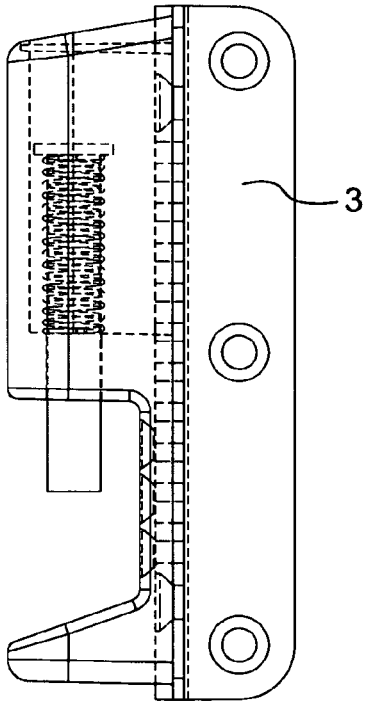
FIG. 8 is a side view of a keeper assembly according to one embodiment of the present invention showing the keeper pin in a lowered, latched position.

FIG. 8 shows the keeper assembly 3 in a latched position. In this position, the pin 17, which as noted is made of magnetic material, is extended downwardly and the pin spring 18 is compressed.

Figure 9:
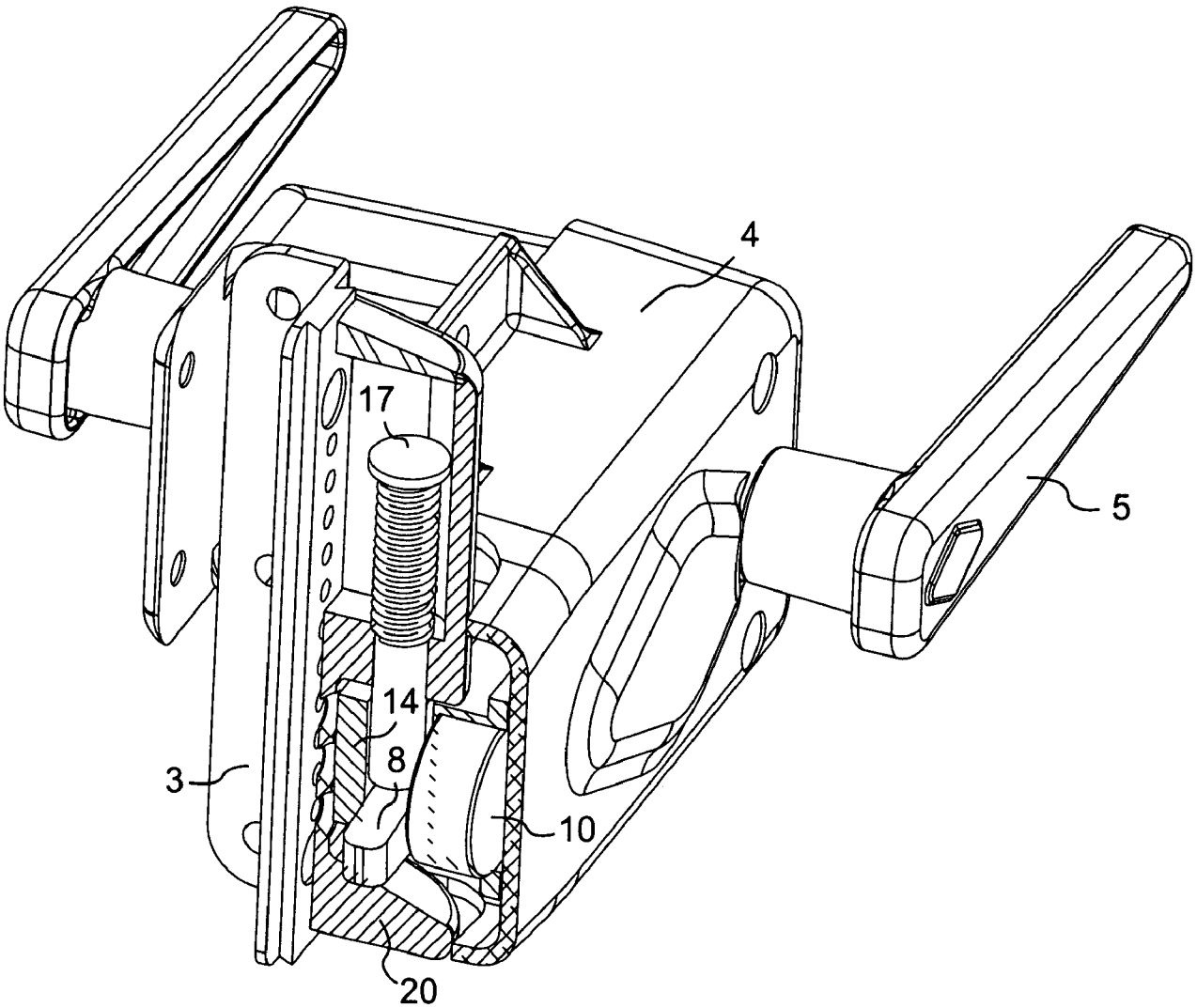
FIG. 9 is a perspective view with portions cut away for clarity showing one embodiment of the magnetic latch system of the present invention in a latched position.

FIG. 9 is a perspective view of the latch system with portions cut away showing the latch system in a latched position. In this latched position, the keeper pin 17, which is made of magnetic material, has been drawn under the influence of magnet 10 into the opening in the magnet housing 12, formed by wall 14. The internal lever 8, held essentially horizontal by the lever spring 7 in FIG. 11, resides below the engaged keeper pin 17. The interaction of keeper pin 17 and wall 14 creates the locking resistance to resist opening the gate by pushing or pulling. The position of keeper pin 17 in FIG. 9 corresponds to the position depicted in FIG. 8 described above and in FIG. 11, described below.

Figure 10:
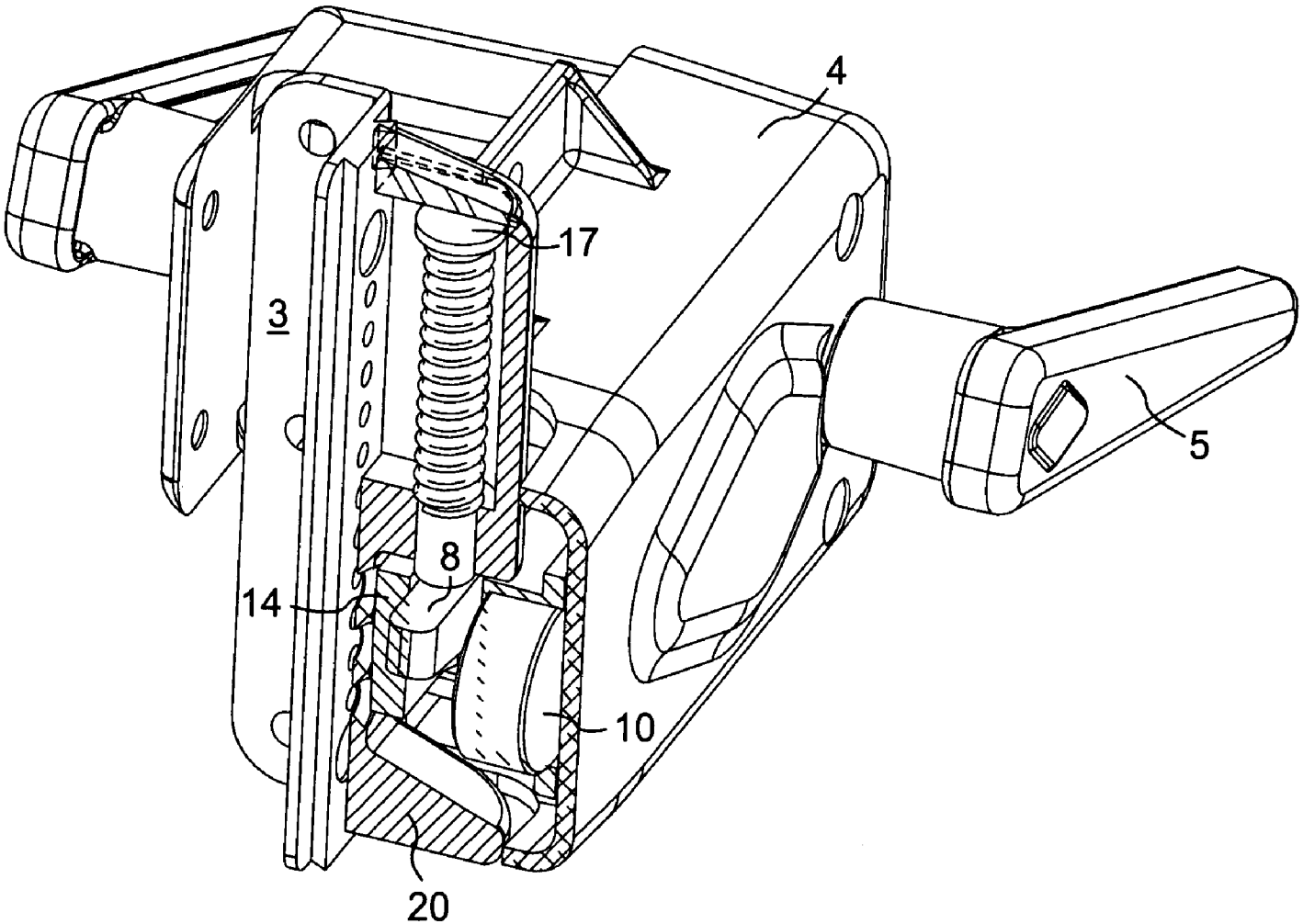
FIG. 10 is a perspective view with portions cut away, showing the magnetic latch system of the present invention in an unlatched position.

FIG. 10 is a perspective cut away view of the latch system in the unlatched but closed position. Handles 5 have been rotated downwardly and in the clockwise direction which, in turn, rotates the internal lever 8 causing the outer end of lever 8 to move upwardly against the bottom of pin 17. Keeper pin 17 is pushed upward by internal lever 8 until the end of keeper pin 17 is able to clear the wall 14 by having its lower end of pin 17 above the top of wall 14. Once the keeper pin 17 has cleared the upper edge of wall 14, the gate can be pushed/pulled open.

Figure 11:
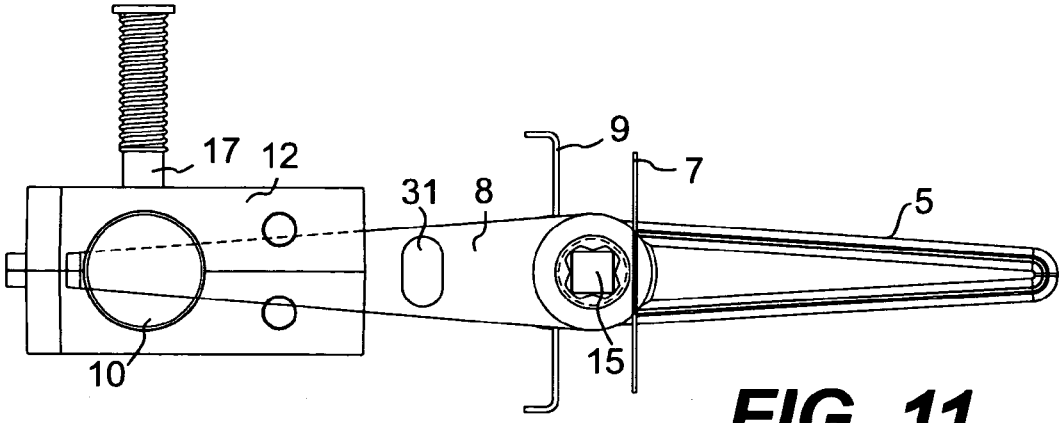
FIG. 11 is a schematic view illustrating the internal components of the latch system of the present invention when in the latched position.
Figure 12:
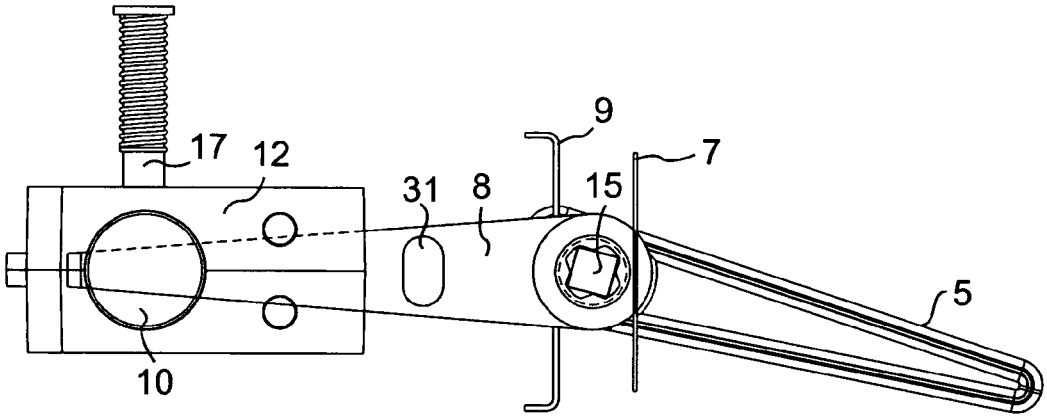
FIG. 12 is a similar view illustrating the handle partially rotated in the clockwise direction.
Figure 13:
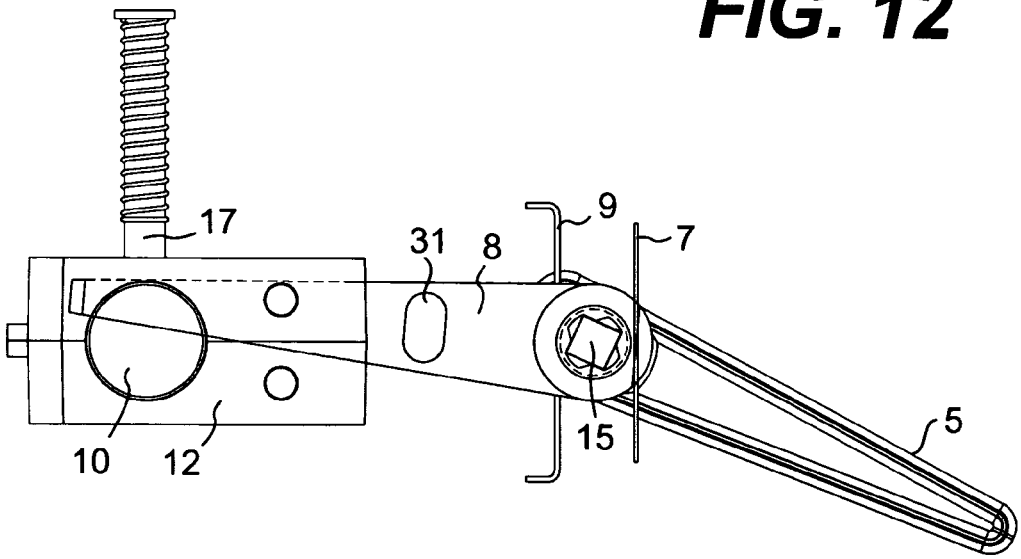
FIG. 13 is a similar view showing the internal components in an unlatched position after the handle is rotated further in the clockwise position and the internal lever is thus rotated in the clockwise direction and engages the keeper pin to move it in a upward direction.

FIGS. 11–13 show the latch system without the housing components and depicts various stages from a latched position to a fully unlatched position in FIGS. 11–13, respectively.

FIG. 11 depicts the keeper pin 17 in its lower position wherein it is attracted by the magnetic force of magnet 10. Further, in FIG. 11, lever 8 is in its downward most position being biased there by spring 7.

FIG. 12 shows the handle 5 partially rotated in a clockwise direction whereby spindle 15 engages with the lugs in through hole 26 to thereby solidly connect handle 5 by way of spindle 15 to the rotatable hub of lever 8. In the position of parts of FIG. 12, the keeper pin 17 is still in its lowermost position held in place by the magnetic force of magnet 10 acting on the magnetic material of keeper pin 17.

FIG. 13 depicts handle 5 further rotated in a clockwise direction compared to FIG. 12 and it depicts the interconnected movement between handle 5 and lever 8 which is moved in a clockwise position relative to the position depicted in FIG. 12. The clockwise position of lever 8 engages the lower end of keeper pin 17 and moves it upward away from the magnetic force of magnet 10. In FIG. 13, the keeper pin 17 is sufficiently raised that the keeper pin no longer is engaged in the slot formed between the front and the back of the magnet housing 12. More specifically, the lower portion of keeper pin 17 is higher than the upper surface of wall 14 which is depicted in FIGS. 3 and 10.

Although not shown, when handle 5 is moved in a counterclockwise direction relative to its position in FIG. 13, the lever 8 also rotates in a counterclockwise direction and returns to the position depicted in FIG. 11. During this latter described movement, spindle spring 9 acts upon a flat surface or spot 16 on the spindle spring bushing 11 (see FIGS. 2 and 5) and provides spring bias for urging handle 5 into a counterclockwise direction to reach the at-rest position depicted in FIG. 11.

Figure 15:
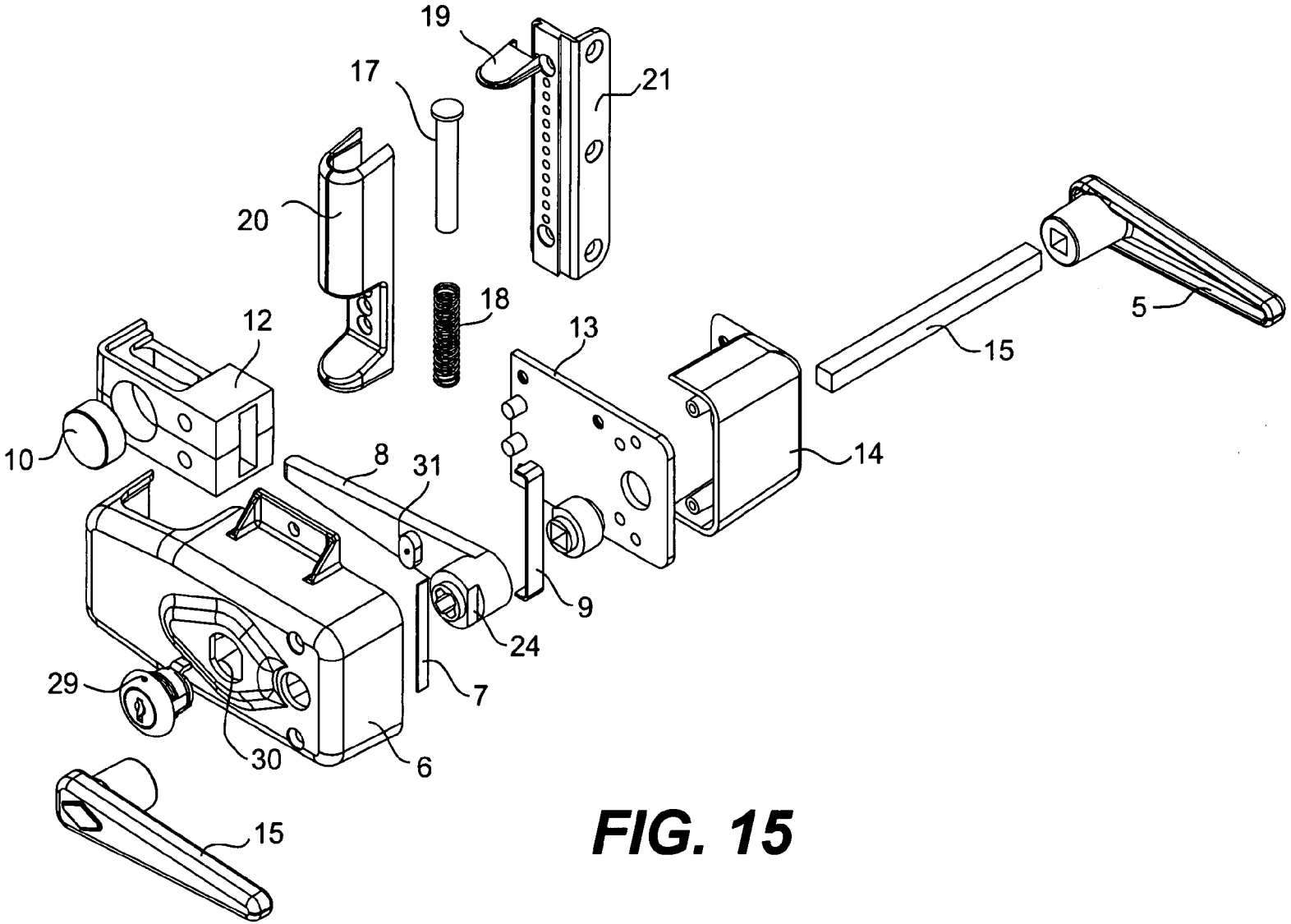
FIG. 15 is an exploded view of the latch assembly of FIG. 14.

FIG. 15 is an exploded perspective view of an embodiment of the present invention which includes a key cylinder and a mechanism to lock the internal lever into a fixed neutral position as illustrated in FIG. 11. The part numbers on the parts in FIG. 1 are applied to corresponding parts in FIG. 15.

Figure 14:
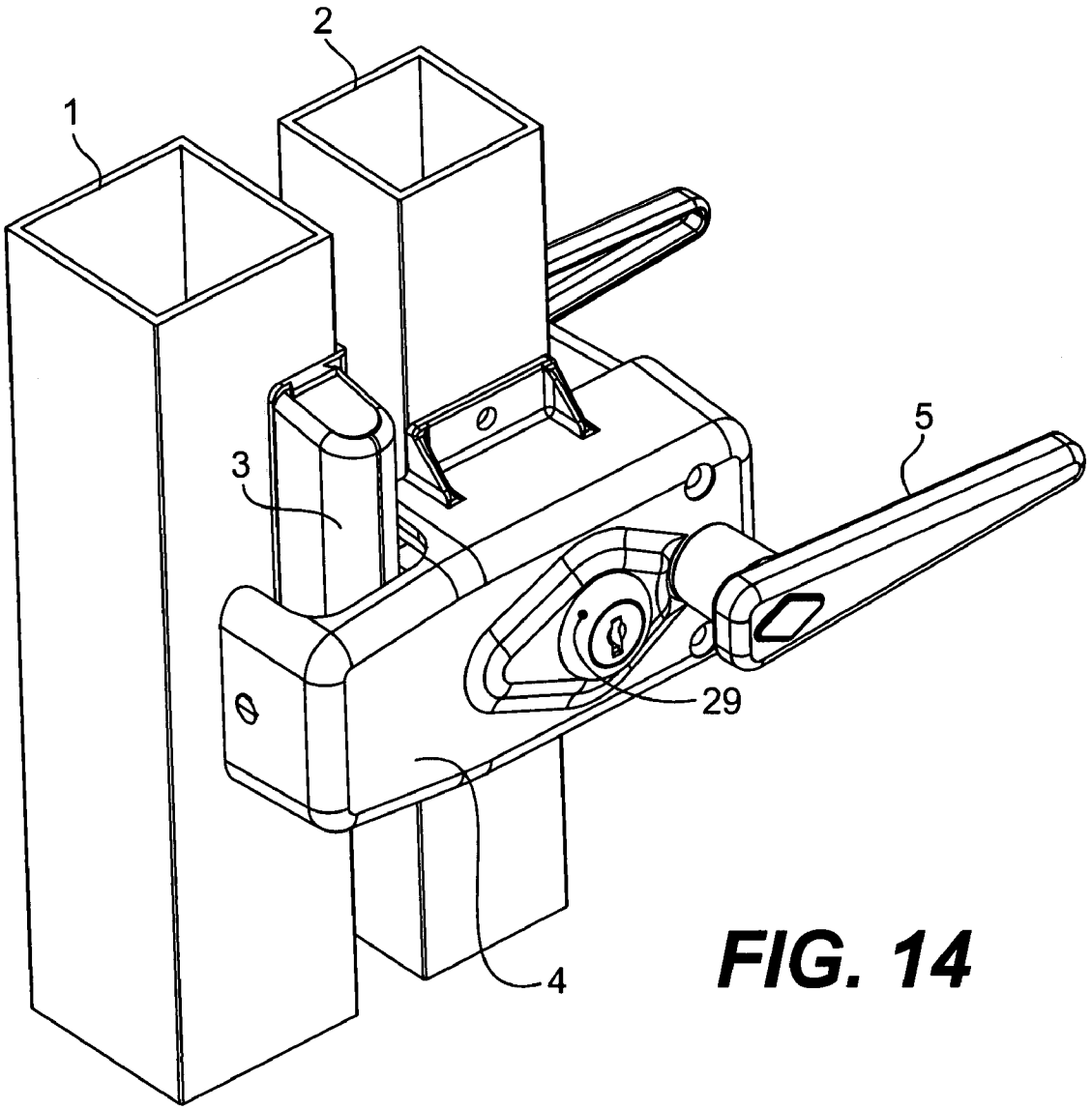
FIG. 14 is an overall perspective view of another embodiment of a lockable magnetic latch system mounted to fence and gate posts.

FIGS. 14–15 show a key cylinder 29 which is mounted into an opening 30 on the front face of the front housing 6 for the latch assembly 4. As best seen in FIG. 15, opening 30 has a non-circular shape to accept the exterior of the key cylinder 29 which interacts to hold the key cylinder 30 from rotation relative to the opening 30. FIG. 15 also shows a locking protrusion 31 extending from the front face of the internal lever 8.

Figure 17:
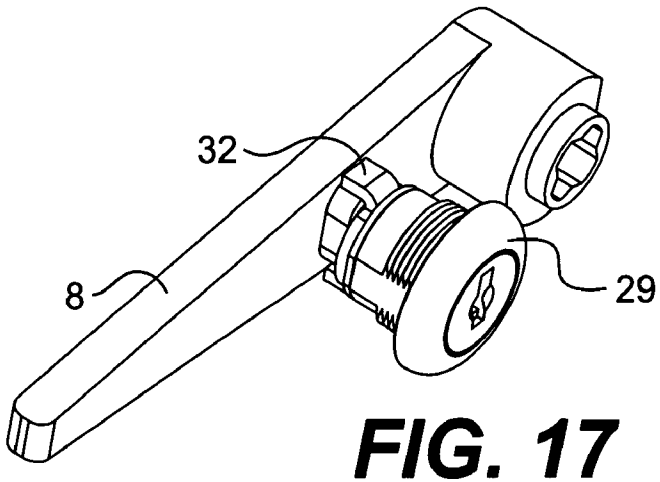
FIG. 17 is a perspective view of the arrangement of the key cylinder and the internal lever in locked position.
Figure 16:
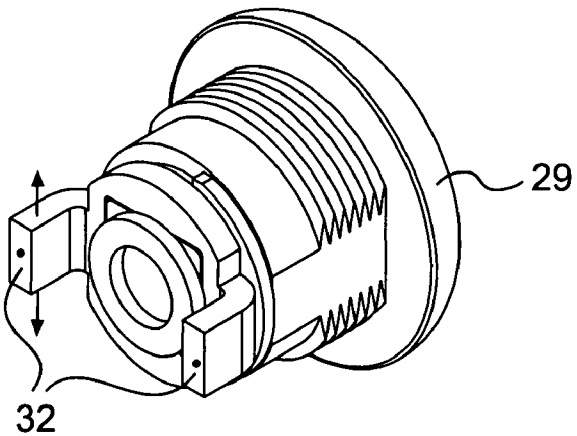
FIG. 16 is a perspective view of the key cylinder device used in the embodiment of FIG. 14.

FIG. 16 illustrates the end of the key cylinder opposite to the front end of the key cylinder 29. The locking ears 32 shown in FIG. 16 extend from a central plate which is rotated when the key is rotated in the locking cylinder 29. Thus, when the key cylinder 29 is rotated in one direction, the locking ears 32 are brought into the position shown in FIG. 17 wherein they extend over and under locking protrusion 31 to block any rotation of internal lever 8, thereby holding the locking lever 8 in a position as depicted in FIG. 11 where it is blocked from being rotated so that its outer end moves the keeper pin 17 in the upward direction to be released from the magnetic force of magnet 10.

Figure 18:
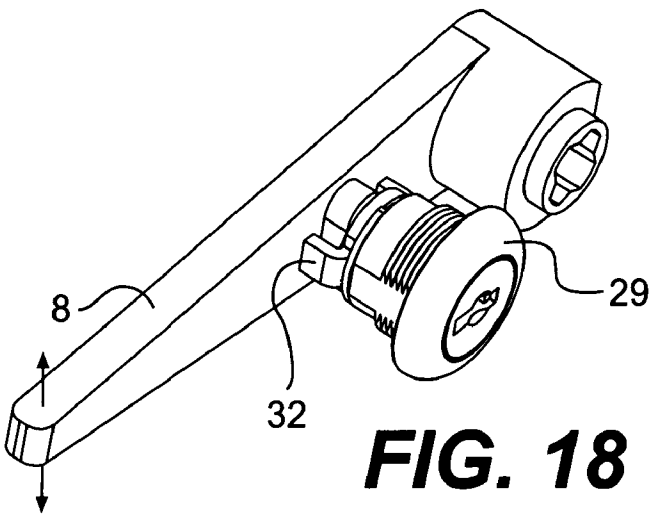
FIG. 18 is a similar perspective view with the key cylinder in the unlocked position.

When the key cylinder 29 is rotated in the other direction, the locking ears 32 are brought into the position shown in FIG. 18 wherein they extend on each side of locking protrusion 31 and thereby allow internal lever 8 to be rotated to the position in FIG. 13 since the locking ears 32 are not blocking the movement of the locking protrusion 31.

It should be appreciated that the various components of the latch assembly and keeper assembly can be formed from metal or plastic utilizing well known fabrication techniques including die-casting, injection molding and the like. The lever spring and handle spring can be conveniently made from any suitable spring metal or material. The magnet 10 is a permanent magnet made according to conventional manufacturing techniques for permanent magnets. The keeper pin 17 may be made of any magnetically attractable material of suitable strength, such as iron or an iron alloy.

What is claimed is:

1. A magnetic latch system adapted to secure a movable gate relative to a fixed post, said system comprising a latch assembly adapted for mounting on said gate and a keeper assembly adapted for mounting on said fixed post;

said keeper assembly comprising a keeper back plate, a keeper housing mounted on said back plate, a magnetically attractable keeper pin movably mounted on said keeper housing, a coil spring for biasing said keeper pin in a normally upward position;

said latch assembly comprising a base mountable on said movable gate, a spindle rotatably mounted on said base, a handle mounted on said spindle for manual rotation of said spindle, an internal lever mounted on said spindle for rotation therewith, said internal lever having an outward end spaced from said spindle, said outward end being movable in an upward and downward direction, a permanent magnet mounted on said base;

said latch assembly being adapted to be cooperatively arranged with said keeper assembly so that said permanent magnet attracts said keeper pin in a downward direction when the keeper pin is adjacent said magnet, the outward end of said internal lever being arranged to engage said keeper pin and move it in an upward direction away from the magnetic attraction between the keeper pin and said permanent magnet;

said base being movable into a position where said keeper pin engages said base when said keeper pin is in its downward position and disengages from said base when said keeper pin is moved in an upward direction by said outer end of said internal lever.

2. A magnetic latch system adapted to secure a movable gate element relative to a fixed post element, said system comprising a latch assembly adapted for mounting on said gate element and a keeper assembly adapted for mounting on said fixed post element;

said keeper assembly comprising a keeper base, a magnetically attractable keeper pin movably mounted on said keeper base, and a coil spring for biasing said keeper pin in a normally upward position;

said latch assembly comprising a base mountable on said movable gate element, a spindle rotatably mounted on said base, a handle mounted on said spindle for manual rotation of said spindle, an internal lever mounted on said spindle for rotation therewith, said internal lever having an outward end spaced from said spindle and movable in an upward and downward direction, and a permanent magnet mounted on said base;

said latch assembly being adapted to be cooperatively arranged with said keeper assembly so that said permanent magnet acts to attract said keeper pin in a downward direction when the keeper pin is adjacent said magnet, said internal lever being arranged to engage said keeper pin and move it in an upward direction to reduce the magnetic attraction between said keeper pin and said permanent magnet;

said base and gate element being adapted to be movable into a position where said keeper pin engages said base when said keeper pin is in its downward position and disengages from said base when said keeper pin is moved in an upward direction by said internal lever.

3. The magnetic latch system of claim 2, wherein said keeper base comprises a back plate for mounting on said fixed post element and a keeper housing mounted on said back plate.

4. The magnetic latch system of claim 3, wherein said keeper housing is slidably mounted on said back plate so that said housing is adjustable relative to said back plate.

5. The magnetic latch system of claim 4, wherein said keeper housing is slidable in a substantially vertical direction on said back plate.

6. The magnetic latch system of claim 4, wherein said keeper housing is connected to said back plate by a mortise and tenon attachment.

7. The magnetic latch system of claim 3, wherein said housing encloses said keeper pin and said coil spring.

8. The magnetic latch system of claim 2, wherein said spindle extends from the front to the back of said gate element and each end of said spindle has a handle for manual rotation of said spindle.

9. The magnetic latch system of claim 2, wherein said internal lever is mounted on said spindle by a lost-motion connection which includes an opening through said internal lever, said opening receiving said spindle and having an internal lug engageable by a surface on said spindle, said spindle and lug being arranged to permit partial rotation of said spindle in said opening until said spindle engages said lug and then begins to provide a turning movement to said internal lever.

10. The magnetic latch system of claim 2, wherein said permanent magnet is mounted on said base at a first vertical location and said internal lever is normally positioned with its longitudinal axis at substantially the same vertical location, and said keeper pin has a lower end that is positioned at substantially the same vertical location when said keeper pin is in its downward position.

11. The magnetic latch system of claim 10, wherein said keeper pin is spaced from said keeper base and said latch assembly base has a wall portion that is interposed between said keeper pin and said keeper base when said keeper pin is in its downward position, whereby said wall portion is held against said keeper base and is blocked from movement relative to said keeper pin.

12. The magnetic latch system of claim 2, further including means mounted on said base for locking said latch in the closed position.

13. The magnetic latch system of claim 12 wherein said means for locking includes a key cylinder, a locking ear mounted on said cylinder for movement into a locking position and into an unlocked position, said locking ear being arranged to cooperate with said internal lever to hold it in a fixed position when said keeper pin is in the latched position.

14. A magnetic latch system comprising a latch assembly and a keeper assembly, said keeper assembly comprising means for providing a keeper base, magnetically attractable keeper pin movably mounted on said keeper base means, a coil spring for biasing said keeper pin in a retracted position;

said latch assembly comprising a base, a spindle rotatably mounted on said base, a handle mounted on said spindle for manual rotation of said spindle, an internal lever mounted on said spindle for rotation therewith, said internal lever having an outward end spaced from said spindle, said outward end being movable, and a permanent magnet mounted on said base;

said latch assembly being adapted to be cooperatively arranged with said keeper assembly so that said permanent magnet attracts said keeper pin when the keeper pin is adjacent to said magnet, the outward end of said internal lever being arranged to engage said keeper pin and move it into the retracted position away form the magnetic attraction between the keeper pin and said permanent magnet;

said base being movable into a position where said keeper pin engages said base when said keeper pin is in its extended position and disengages from said base when said keeper pin is moved into its retracted position by said outer end of said internal lever.

* * * * *

UNITED STATES PATENT AND TRADEMARK OFFICE

CERTIFICATE OF CORRECTION

PATENT NO. : 7,044,511 B2
APPLICATION NO. : 10/971709
DATED : May 16, 2006
INVENTOR(S) : Christopher Kliefoth et al.

It is certified that error appears in the above-identified patent and that said Letters Patent is hereby corrected as shown below:

Col. 8, Claim 14, line 19, delete “form” and substitute therefor --from--.

Signed and Sealed this

Fifteenth Day of August, 2006

JON W. DUDAS
*Director of the United States Patent and Trademark Office*